United States Patent [19]

Bozai

[11] Patent Number: 4,643,669

[45] Date of Patent: Feb. 17, 1987

[54] SMOKELESS FLARE GAS BURNER

[75] Inventor: Mohammed Z. Bozai, Nyack, N.Y.

[73] Assignee: Peabody Engineering Corporation, Stamford, Conn.

[21] Appl. No.: 769,455

[22] Filed: Aug. 26, 1985

[51] Int. Cl.[4] ..... F23D 21/00

[52] U.S. Cl. ..... 431/202; 431/4; 431/5; 431/114

[58] Field of Search ..... 431/3, 4, 5, 190, 202, 431/114

[56] References Cited

U.S. PATENT DOCUMENTS

| | | | |
|---|---|---|---|
| 2,802,521 | 8/1957 | Campbell et al. | 431/5 |
| 2,891,607 | 6/1959 | Webster et al. | 431/202 |
| 3,134,424 | 5/1964 | Zink et al. | 431/5 |
| 3,547,567 | 12/1970 | Turpin | 431/202 |
| 3,554,681 | 1/1971 | Procter | 431/202 |
| 3,982,881 | 9/1976 | Schwartz et al. | 431/202 |
| 3,994,671 | 11/1976 | Straitz | 431/202 |
| 4,486,167 | 12/1984 | McMurray et al. | 431/202 |

FOREIGN PATENT DOCUMENTS

| | | | |
|---|---|---|---|
| 2014448 | 8/1979 | United Kingdom | 431/202 |

*Primary Examiner*—Margaret A. Focarino

*Attorney, Agent, or Firm*—St. Onge, Steward, Johnston & Reens

[57] ABSTRACT

A flare gas burner is described in which a deflector shell approximating a half Venturi is disposed about the upper end of a waste gas delivery pipe equipped with standard pilot-flame igniters and flame stabilizers. A manifold on the lower end of the deflector delivers motive fluid (air, steam) under high pressure into the passageway between the deflector and pipe. The fluid is directed by the inwardly inclined upper lip of the shell into the path of emissions from the waste gas pipe. Heat shields and noise shields are incorporated into the assembly. Additional whirling and turbulence is imparted to the stream of motive fluid by appropriate shaping of spacer plates securing the deflector to the waste gas pipe.

The structure is less complex than previously known devices, has improved ease of maintenance, and gives excellent performance in smokeless flaring of waste gas.

18 Claims, 5 Drawing Figures

SMOKELESS FLARE GAS BURNER

BACKGROUND OF THE INVENTION

1. Field of the Invention

This invention relates to flare gas burners and is more particularly concerned with an improved apparatus and method for smokeless burning of waste gas.

2. Description of the Prior Art

Many flare gas burners of varying degrees of complexity have been developed to improve combustion of waste (or "dump") gas and to suppress smoke and/or noise.

Illustratively, Zink U.S. Pat. No. 2,779,399 shows a flare stack burner having a series of pilot burners surrounding the main opening from which waste gas is discharged at high velocity by injecting a mixture of air and steam into the waste gas stream at a plurality of points.

Webster et al U.S. Pat. No. 2,891,607 provides a burner comprising a plurality of concentric pipes, the innermost pipe and the space between the two outermost pipes having steam discharge members for inducing air into the burning gases. The waste gas is delivered through an intermediate annular passage defined by the concentric pipes.

Procter U.S. Pat. No. 3,554,681 shows a flare burner provided with a frustoconical deflector which forms the upper end of the tip. A steam manifold encircles the tip and serves to induce air (via devices producing a Coanda effect) into the lower portion of the deflector. Waste gas is delivered to the tip via a gas stream diverter which displaces the stream towards the walls of the tip. The air streams and waste gas streams are caused to intersect at approximately 90 degrees.

Straitz U.S. Pat. No. 3,797,991 discloses a series of spaced apart steam nozzles for inducing air flow into the region above the flare tip. British Pat. No. 1,604,441 shows a similar device in which the nozzle devices produce a Coanda effect.

Straitz U.S. Pat. No. 3,994,671 teaches a flare gas burner comprising a plurality of concentric pipes by means of which the waste gas is delivered in a whirling path and caused to intersect with streams of air and steam, also in whirling paths, delivered by inner and outer pipes. A sound absorbing shroud and acoustical baffles are integrated into the device. Straitz U.S. Pat. No. 3,995,986 shows a related device.

Hemmer et al U.S. Pat. No. 4,019,852 shows a flare gas burner the tip of which is surrounded by an annular manifold from which a series of tubes project upwardly and outwardly. A stream of steam air is ejected through outwardly facing slits in said tubes and serves to draw atmospheric air between said tubes and into the stream of waste gas emerging from the tip.

German OLS No. 2 154 785 discloses a device for exhausting and purifying waste gas contaminated with phenol, resins and like material. The waste gas is passed through a first Venturi-like chamber having a flare burning in the throat thereof, the first chamber and associated flare projecting into the throat of a large Venturi which serves to induce a current of air to intermingle with the waste gas being exhausted.

European patent application No. 0054383 shows a flare gas burner using a Coanda effect and provided with a funnel shaped noise shield located below the tip.

The present invention provides a smokeless flare gas burner of greatly simplified construction and characterized by ease of maintenance, reduced noise level and high overall efficiency.

SUMMARY OF THE INVENTION

It is an object of the invention to provide an improved smokeless flare gas burner. It is a further object of the invention to provide a smokeless flare gas burner of simplified construction and greater ease of maintenance.

It is yet a further object of the invention to provide a smokeless flare gas burner having a high degree of efficiency and a reduced noise level.

These object, and other objects which will become apparent from the description which follows, are achieved by the improved smokeless flare gas burner of the present invention. The burner of the invention in its broadest aspect comprises a stack or waste delivery pipe through which flare gas is fed, and having a deflector disposed externally about the upper end thereof. The deflector approximates the shape of a half Venturi with the throat uppermost and is supported in fixed spaced apart relationship with the waste delivery pipe. An annular manifold is mounted adjacent the lower end of the deflector. Motive fluid, which can be air, steam, gas and like propellants, is delivered to the manifold under elevated pressure and is ejected therefrom through appropriate nozzle means upwardly into the passage defined by the inner wall of the deflector and the outer wall of the waste gas delivery pipe. Atmospheric air is thereby induced to flow upwardly through said passage. In a preferred embodiment the lip of the throat of the deflector is inclined inwardly towards the longitudinal axis of the waste gas pipe and serves to deflect the stream of motive fluid and induced air into the path of the flare emerging from the waste gas pipe. The stream of motive fluid and induced air can have a whirling motion imparted thereto by appropriate shaping of spacer plates holding the deflector in fixed relationship with the waste gas delivery pipe.

In an optional and preferred embodiment the deflector has a heat shield disposed on the exterior thereof and projecting outwardly and downwardly therefrom. In another optional and preferred embodiment a noise shield is disposed on the waste gas delivery pipe below the entrance to the passage between the deflector and the waste gas delivery pipe.

Optionally, additional motive fluid at elevated pressure can be delivered to a location situated within the waste gas delivery pipe to improve the smokeless operation by increasing the overall combustion efficiency of the system.

BRIEF DESCRIPTION OF THE DRAWINGS

The nature and characteristic features of the invention will be readily understood from the following description taken in conjunction with the accompanying drawings wherein.

DETAILED DESCRIPTION OF THE INVENTION

Figure 1:
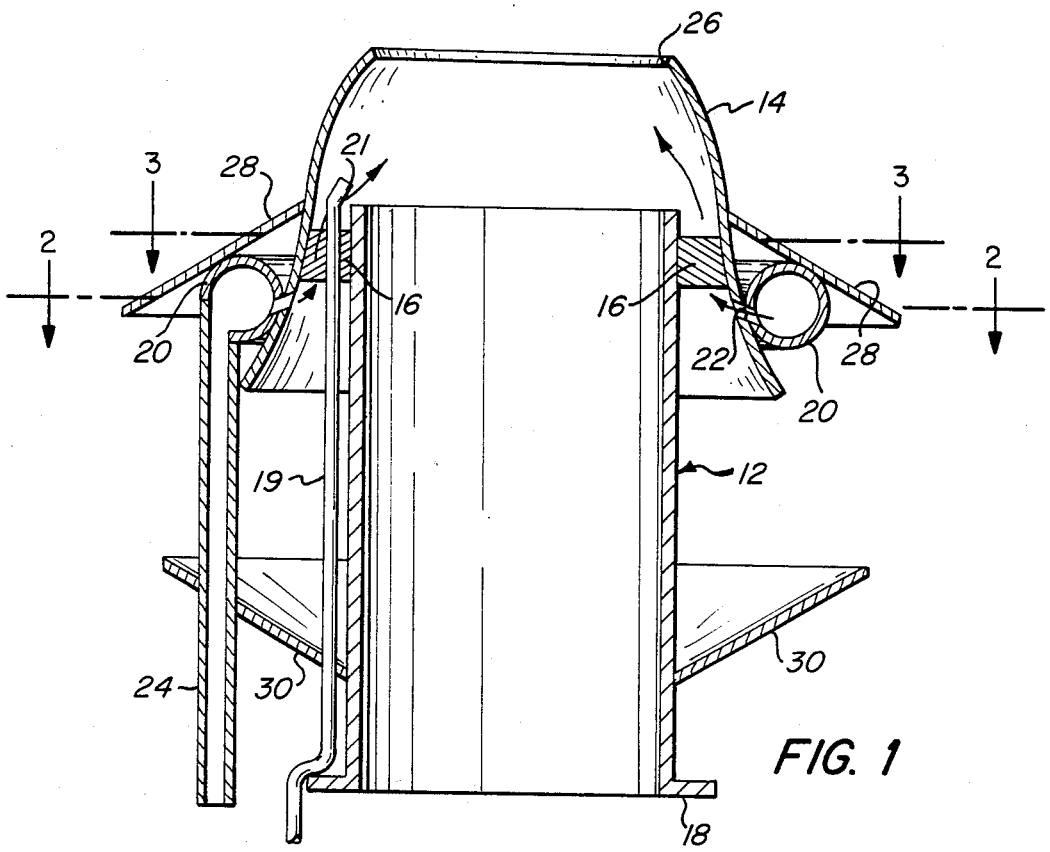
FIG. 1 is a cross-sectional view taken along the longitudinal axis of a flare gas burner in accordance with the invention.

Referring now to FIG. 1 the flare gas burner shown generally at 10 comprises a burner tip 12 provided with flange 18 or like means for attachment to the stack of the flare gas burner. A plurality of conventional pilot flame igniters, of which one is shown as 19 with pilot tip 21, are spaced circumferentially around the upper end of tip 12. Optionally, any of the flame stabilizers known in the art can also be installed in appropriate manner on tip 12. A deflector 13 shaped substantially in the form of a half Venturi with the throat uppermost is disposed on the upper end of the tip 12 and spaced therefrom and rigidly attached thereto by spacer elements or plates 16. Annular manifold 20 is disposed on the lower outer surface of the deflector 14 and is provided with a plurality of orifices or slots 22 which are aligned with corresponding orifices or slots in the deflector 14. Motive fluid which can take the form of steam, gas, air or similar propellants is supplied to manifold 20 through one or more delivery pipes 24 under pressure and is discharged through orifices or slots 22 into the passage defined by the interior of deflector 14 and the exterior of the top of burner tip 12. The motive gas discharged into said passage follows a curvilinear path as illustrated by the arrows in FIG. 1 and is deflected inwards into the path of the flare gas emerging from burner tip 12 by the upper rim of the deflector 14. In the embodiment shown in FIG. 1 said rim 26 is curved inwardly to achieve the desired deflection of the motive fluid stream inwardly. It will be obvious to those skilled in the art that the exact configuration of this rim is not critical. Illustratively said rim could be planar provided that the desired deflection inwardly of the motive fluid stream is achieved.

Further, as illustrated in the embodiment of FIG. 1, the deflector 14 is disposed so that its rim 26 is disposed above the top of flare tip 12. While this is a preferred embodiment it is to be understood that the relative positions of the deflector and the upper end of the tip can be varied without departing from the scope of the invention. The exact relationship of the two components which gives maximum efficiency in any given instance will depend on the relative size and shape of the deflector and the size of the upper opening in the burner tip 12.

A frustoconical heat shield 28 is disposed about the exterior of deflector 14 and is held in rigid relationship therewith by welds or like connecting means. The heat shield projects downwardly and outwardly over the manifold 20 and can be secured thereto by appropriate means such as slotted brackets and the like if so desired. The shield 28 serves to minimize the heat radiation downwardly from the flare gas burner and also prevents the flame of the flare from rolling over the edge of the deflector 14 or being sucked back into the area between deflector 14 and flare gas pipe 12. A frustoconical noise shield 30 is disposed on the outer surface of burner tip 12 and secured thereto by appropriate means such as welds and the like. The noise shield projects upwardly and outwardly a lateral distance which is preferably greater than the opening between the lower end of the deflector 14 and the exterior of the tip 12. Optionally, but preferably, the noise shield is lined with noise abatement material. The noise shield serves to absorb, and also divert away from ground level, the noise generated by the discharge of the motive fluid at elevated pressure from orifices or slots 22.

Figure 2:
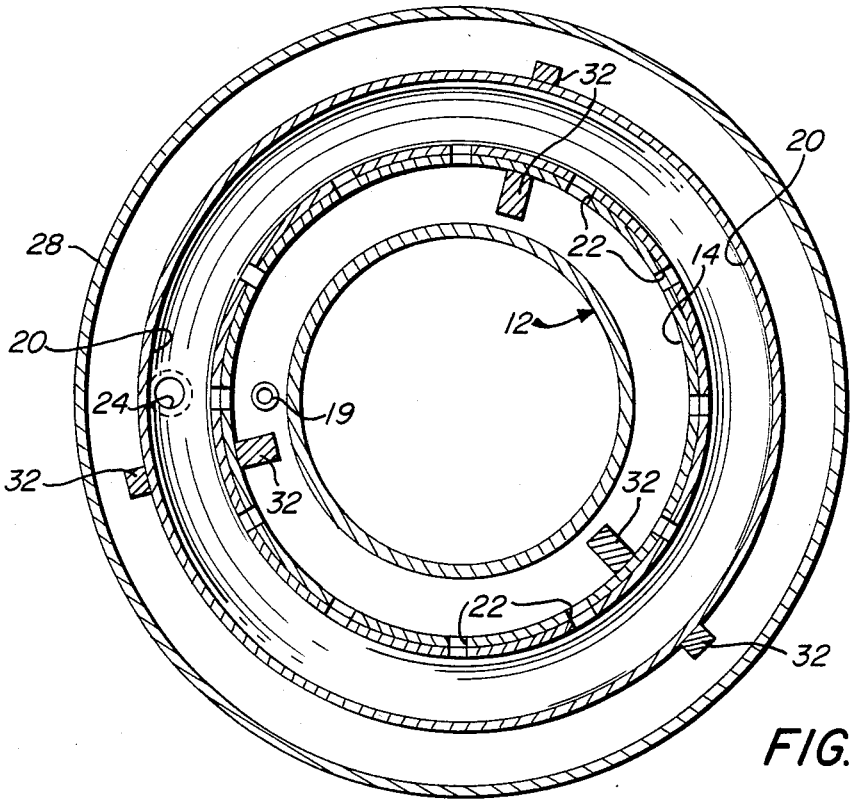
FIG. 2 is a horizontal sectional view taken approximately on the line 2—2 of FIG. 1.

FIG. 2 is a cross-sectional view taken along line 2—2 of FIG. 1. The elements common to FIG. 1 and FIG. 2 are shown using the same numerals. The orifices or slots 22 in the manifold 20 shown in FIG. 2 are substantially symmetrically disposed around the inner circumference of the manifold 20. The orifices can take the form of slots with the length thereof disposed horizontally or vertically. The orifices can also take other forms such as circular holes, jets and the like. The number and precise disposition of the orifices is not critical. The manifold is held in place on the deflector 14 by support members 32.

Figure 3:
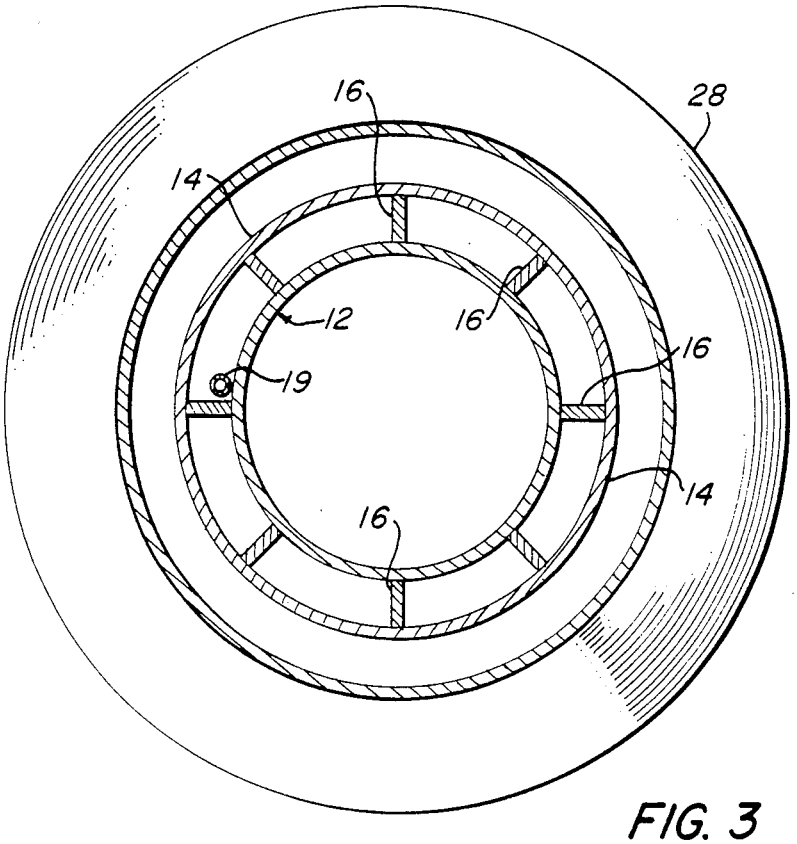
FIG. 3 is a horizontal sectional view taken approximately on the line 3—3 of FIG. 1.

FIG. 3 is a cross-sectional view of the embodiment of FIG. 1 taken along the line 3—3. The elements common to FIGS. 1 and 3 are shown using the same numerals. FIG. 3 shows a series of spacer elements 16 which serve to hold the deflector 14 in rigid relationship with the flare tip 12. The spacer elements 16 can take the form of planar struts aligned vertically or, in a preferred embodiment, said struts are inclined to the vertical thereby serving to deflect the motive fluid being discharged upwardly past said struts 16 and cause a turbulence or whirling effect in said motive fluid. The turbulence in the fluid stream so created serves to increase the efficiency of the cumbustion of the flare gas emerging from tip 12. The spacer elements 16 can also be given a curved surface which serves to impart even more pronounced turbulence to the motive fluid stream and the atmospheric air entrained or induced by the motive fluid stream.

Figure 4:
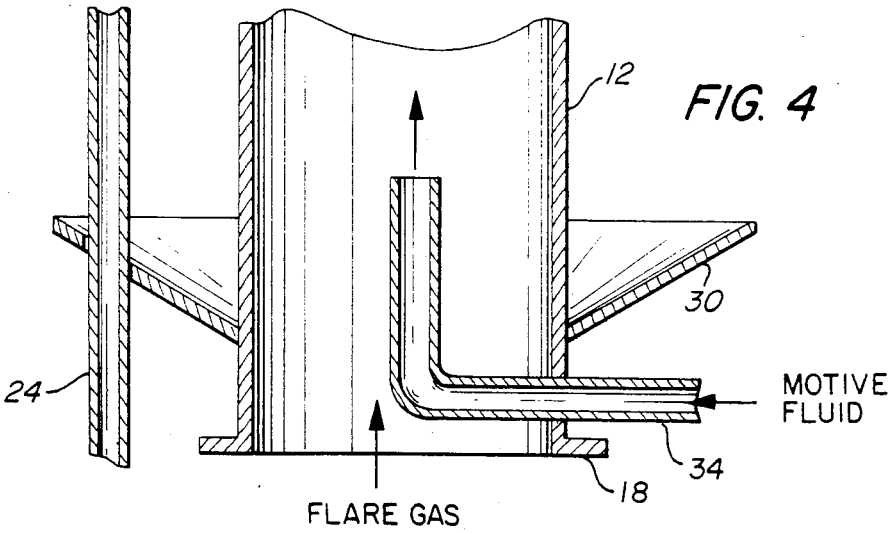
FIG. 4 is a partial vertical cross-sectional view of an alternative embodiment of a flare gas burner in accordance with the invention.

FIG. 4 is a partial cross-sectional view of the lower end of a modification of the flare gas burner shown in FIG. 1. In this modification an additional motive fluid stream is provided through delivery pipe 34 disposed in the lower end of burner tip 12.

Figure 5:
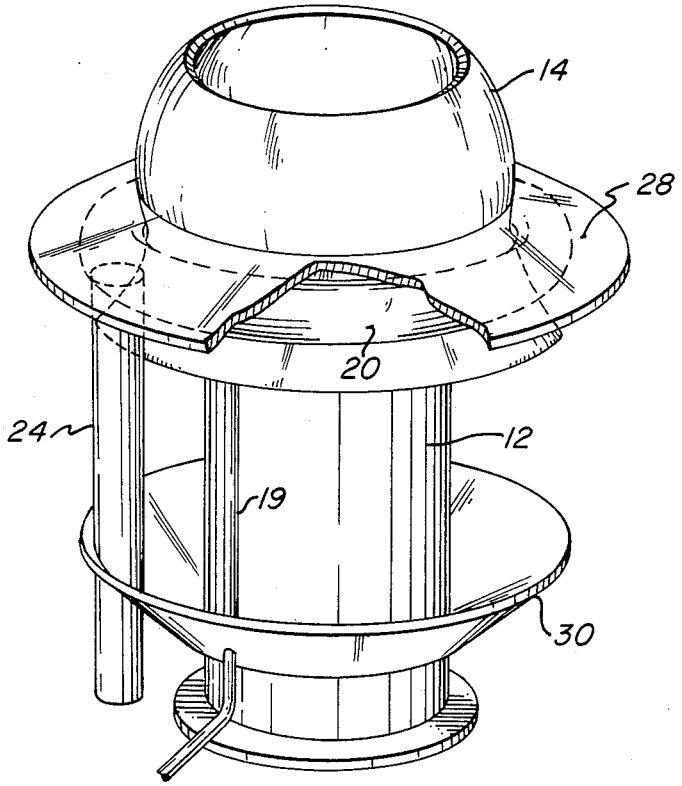
FIG. 5 is a perspective view, partially cutaway, of the flare gas burner shown in perspective in FIG. 1.

FIG. 5 shows a partially cutaway perspective view of the particular embodiment shown in cross-section in FIG. 1. The same numerals are employed in these figures to represent the common elements.

In operation of the flare gas burner shown in FIGS. 1, 2, 3 and 5 a motive fluid such as air, steam or gas is supplied above atmospheric pressure through delivery pipe or pipes 24 to the manifold 20. The motive fluid is discharged from the manifold 20 via orifices 22 and is directed upwardly into the passage between the inner surface of deflector 14 and the outer surface of flare tip 12. The stream of motive fluid so discharged induces an upward stream of atmospheric air to enter the passage and be combined with the motive fluid stream which is discharged inwardly into the path of the flare gas emerging from tip 12. Optionally additional motive fluid can be supplied at the same or a different pressure via a delivery pipe 34 located with its orifice substantially symmetrically disposed in the interior of flare tip 12 as illustrated in FIG. 4.

The flare gas burner of the invention has been illustrated by various specific embodiments described above. It is to be understood that these embodiments have been given for purposes of illustration only and the scope of the invention is not limited thereby. Various modifications and changes can be made in the structures described above without departing from the spirit of the invention.

What is claimed is:

1. A flare gas burner for combustible waste gas comprising:

a waste gas delivery pipe;

deflector means disposed externally about the upper end of said waste gas delivery pipe said deflector means approximating the shape of a half Venturi with the throat uppermost;

an annular manifold disposed on the exterior of the lower end of said deflector means;

means for supporting said deflector in fixed spaced apart relationship with said upper end of said waste gas delivery pipe;

means for supplying high pressure motive fluid to said manifold; and means for discharging said motive fluid from said manifold into the passage defined by the interior of said deflector means and the exterior of said waste gas delivery pipe.

2. A flare gas burner according to claim 1 wherein said deflector means is supported on said waste gas delivery pipe by a plurality of spacer plates.

3. A flare gas burner according to claim 2 wherein said spacer plates are shaped to impart a whirling motion to the high pressure motive fluid passing upwardly in the passage between said deflector means and said waste gas delivery pipe.

4. A flare gas burner according to claim 1 wherein the upper end of said deflector meaqns is inclined inwardly to direct upwardly flaring high pressure motive fluid into the path of emissions from said waste gas delivery pipe.

5. A flare gas burner according to claim 1 which also comprises a heat shield disposed on the exterior of said deflector means and projecting outwardly and downwardly therefrom.

6. A flare gas burner according to claim 1 which also comprises noise baffle means disposed on the exterior of said waste gas delivery pipe below said manifold and said associated deflector means.

7. A flare gas burner according to claim 6 wherein said noise baffle means comprises an inverted frustoconical shield disposed coaxially with respect to said waste gas delivery pipe and extending outwardly from the exterior thereof a distance greater than that by which said manifold is spaced from the exterior of said waste gas delivery pipe.

8. A flare gas burner according to claim 1 which also comprises means located within said waste gas delivery pipe for introducing additional motive fluid into the upwardly flowing waste gas.

9. A flare gas burner for combustible waste gas comprising:

a waste gas delivery pipe;

a deflector shell having substantially the shape of a half Venturi with the throat uppermost;

said deflector being disposed coaxially with and exteriorly of, the upper end thereof of said waste gas delivery pipe:;

an annular manifold disposed on the exterior of the lower portion of said deflector;

support means for holding said deflector assembly in fixed, spaced apart relationship with said upper end of said waste gas delivery pipe;

means for supplying motive fluid under pressure to said manifold; and means for discharging high pressure motive fluid from said manifold into the passage defined by said deflector shell and said waste gas delivery pipe.

10. A flare gas burner according to claim 9 wherein said motive gas is discharged from said manifold via a plurality of orifices disposed substantially symmetrically around said manifold.

11. A flare gas burner according to claim 9 wherein the lip of the throat of said deflector sheel projects above the top of said waste gas delivery pipe and is inclined upwardly and inwardly toward the axis of said deflector shell.

12. A flare gas burner according to claim 9 wherein said support means comprises a plurality of spacer plates.

13. A flare gas burner according to claim 12 wherein said spacer plates are shaped to impart a whirling motion to the motive gas passing upwardly between said deflector shell and said waste delivery pipe.

14. A flare gas burner according to claim 9 which also comprises a heat shield disposed on the exterior of said deflector means and projecting outwardly and downwardly over said manifold.

15. A flare gas burner according to claim 9 which also comprises noise baffle means disposed on the exterior of said waste gas delivery pipe below said deflector shell assembly.

16. A flare gas burner according to claim 15 wherein said noise baffle means comprises an inverted frustoconical shield disposed coaxially with respect to said waste gas delivery pipe and extending outwardly from the exterior thereof a distance greater than that by which said manifold is spaced from the exterior of said waste gas delivery pipe.

17. A flare gas burner comprising in combination:

a waste gas delivery pipe;

deflector means surrounding the upper end of said delivery pipe and spaced therefrom to define a passage therebetween;

means disposed on the exterior of the lower end of said deflector for discharging motive fluid into said passage; and means associated with said deflector means to cause said motive fluid to follow a curvilinear path which ultimately intersects the path of emissions from said delivery pipe.

18. The flare gas burner defined in claim 17 wherein said means for imparting a curvilinear path to said motive fluid also supports said deflector means on said delivery pipe.

* * * * *